United States Patent [19]

Wong

[11] Patent Number: 4,752,423

[45] Date of Patent: Jun. 21, 1988

[54] COMBINED HUMIDIFIER AND FAN HEATER UNIT

[75] Inventor: Man K. Wong, Quarry Bay, Hong Kong

[73] Assignee: Wellman Industrial Company, Ltd., Hong Kong

[21] Appl. No.: 9,198

[22] Filed: Jan. 29, 1987

[30] Foreign Application Priority Data

Sep. 18, 1986 [GB] United Kingdom ..... 8622480

[51] Int. Cl.[4] ..... B01F 3/04

[52] U.S. Cl. ..... 261/142; 261/81; 261/DIG. 48; 219/362; 219/276; 219/363

[58] Field of Search ..... 261/DIG. 48, 142, 81; 219/362, 276, 363

[56] References Cited

U.S. PATENT DOCUMENTS

| | | | |
|---|---|---|---|
| 2,246,069 | 6/1941 | Schechtel et al. | 261/142 |
| 2,590,600 | 3/1952 | Farr et al. | 219/363 |
| 2,759,713 | 8/1956 | Maniscalco, Sr. | 261/142 |
| 2,909,637 | 10/1959 | Mobley | 219/362 |
| 3,105,892 | 10/1963 | Knapp | 219/276 |
| 3,179,386 | 4/1965 | Liebmann | 261/142 |
| 4,003,967 | 1/1977 | Potvin | 261/142 |
| 4,031,171 | 6/1977 | Asao et al. | 261/DIG. 48 |
| 4,520,864 | 6/1985 | Katagiri et al. | 261/142 |
| 4,563,313 | 1/1986 | Tsuaki | 261/DIG. 48 |
| 4,640,804 | 2/1987 | Mizoguchi | 261/DIG. 48 |

FOREIGN PATENT DOCUMENTS

| | | | |
|---|---|---|---|
| 436769 | 1/1948 | Italy | 261/142 |
| 54-56236 | 8/1979 | Japan | 261/DIG. 48 |

*Primary Examiner*—Tim Miles

*Attorney, Agent, or Firm*—Kenyon & Kenyon

[57] ABSTRACT

A combined humidifier and fan heater unit includes a humidifier part (1) electrically operable to dispense water vapour into the surrounding air space for humidifying purposes, and a fan heater part (2) electrically operable either together with or instead of the humidifier part (1) to draw air from the surrounding air space, through heating means (34), by which it is raised in temperature or not as desired, and pass it back into the surrounding air space.

7 Claims, 9 Drawing Sheets

COMBINED HUMIDIFIER AND FAN HEATER UNIT

Figure 1:
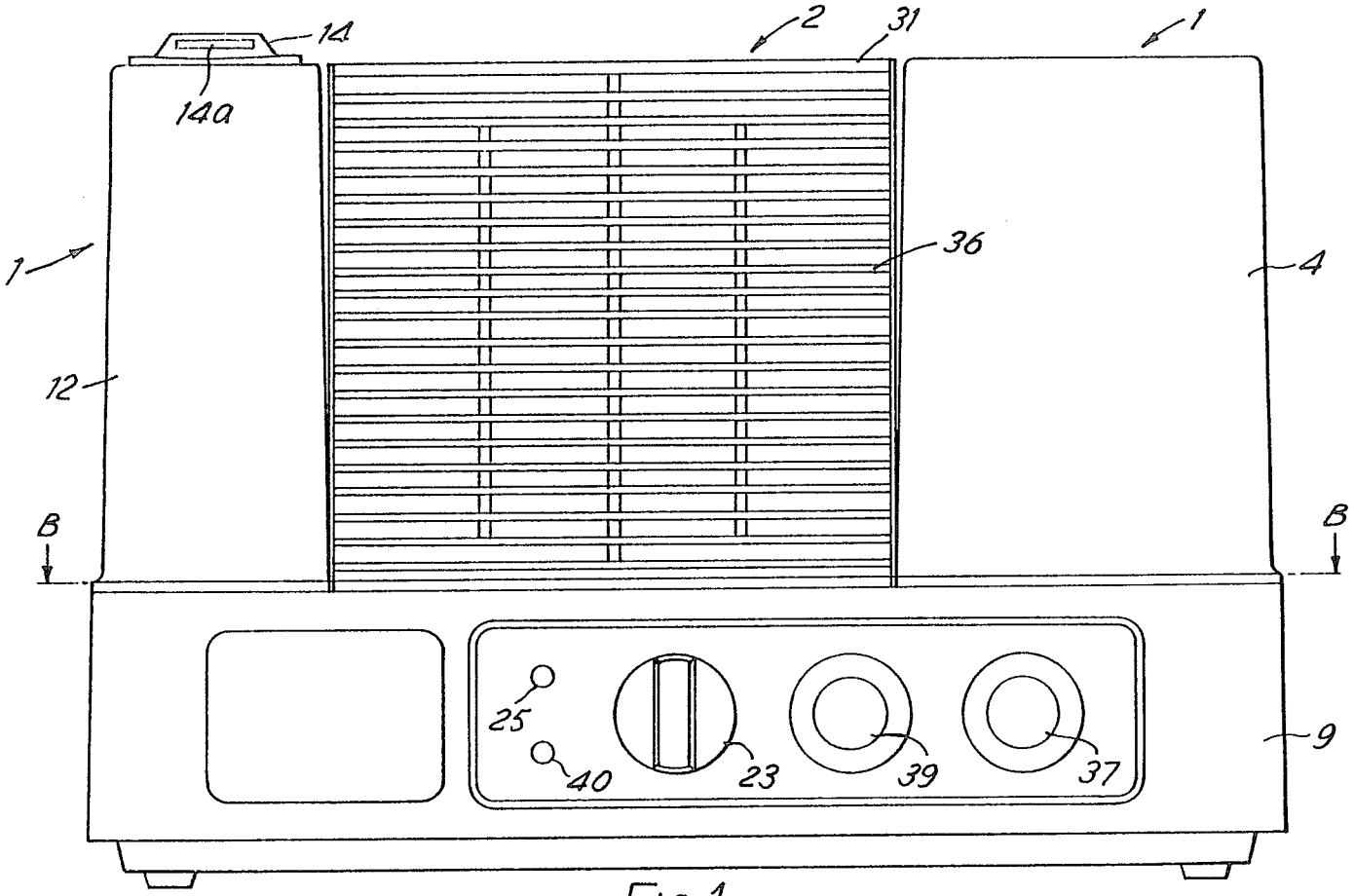

This invention relates to a combined humidifier and fan heater unit suitable for heating or cooling an air space such as in a surrounding room and/or humidifying the surrounding air space by addition of water vapour to the surrounding air space.

Separate fan heaters and humidifiers are known for controlling the temperature and moisture content of a room space. However the use of two separate items means that two separate items have to be purchased with consequent cost, requirement for use of two separate electrical power outlets and difficulty in controlling the two items simultaneously. There is thus a need for a simplified and improved assembly for providing humidifier and heater functions.

According to the present invention there is provided a combined humidifier and fan heater unit including a humidifier part operable from a source of electrical power to dispense water vapour into the surrounding air space for humidifying purposes, and a fan heater part operable from a source of electrical power, either together with or instead of the humidifier part, to draw air from the surrounding air space, through heating means, by which it is raised in temperature or not as desired, and pass it back into the surrounding air space.

Conveniently the humidifier part includes a refillable tank for water, a vibrator for receiving the water from said water tank and operable to impart a vibratory motion to the received water to raise some of it above the normal surface of the water when at rest, and an air blower operable to draw air from the surrounding air space through the vibrated water or across the vibrated surface thereof to entrain water therefrom and break it up into droplets during passage through a vapour chamber, an outlet means in said vapour chamber for discharging the vapour formed by the air and entrained water droplets, into the surrounding air space.

Preferably the vibrator is an electrically operable ultrasonic transducer.

Advantageously the unit includes a base portion on which said water tank and vapour chamber are mountable in spaced apart location, with a water channel extending in the base portion between and in flow communication with the water tank and the vapour chamber, with the vibrator being mounted in said channel, and with a float being arranged in said channel to move with the level of water therein such as to operate a switch and cut-out supply of electrical power to the vibrator and hence stop its operation when the water level in the channel falls below a predetermined minimum.

Conveniently the water tank is removable from the base portion for filling purposes and has a filler orifice through which water may be entered into said tank, with the orifice uppermost, and valve means, normally biased into a closed position, insertable in said orifice, operable so that the waterfilled water tank with the valve means in the filler orifice may be inverted without loss of water through the closed valve means and placed back in position on the base portion which is provided with a projecting valve rod for opening the valve means when the water tank is in the correct location on the base portion, so as to allow water to flow therefrom into the channel.

Conveniently the base portion includes a spring loaded projecting plunger and co-operating contact switch in electrical circuit with the supply of electrical power to the vibrator and/or the air blower, operable so that when the base portion is normally located for operation on a flat, substantially horizontal, surface the plunger engages the flat surface against the spring bias and holds the contact switch in a closed position to permit flow of electrical supply current to the vibrator and/or air blower, but when the base portion is knocked over or lifted from the flat surface the plunger extends under the spring bias action and opens the contact switch thereby cutting off flow of electrical supply current to the vibrator and/or air blowr and stopping operation of the humidifier part.

Advantageously the fan heater part includes a casing containing a fan rotor, an electrically operable motor for rotating said fan rotor, and an electrically operable heater element, an air inlet to said casing and an air outlet from said casing, such that air may be drawn into the casing from the surrounding air space through the air inlet by the rotating fan rotor, through the heater element to be heated as desired thereby and through the fan rotor and thereby blown out of the casing through the air outlet back into the surrounding air space.

Preferably the casing is located on the base portion between the spaced apart water tank and vapour chamber.

Conveniently the fan heater part includes one or more thermostats selectively adjustable to desired limit temperatures such that when switched on the fan heater part will be switched off by the thermostats when the temperature of the surrounding air space reaches the selected upper limit temperature and switched back on when the temperature of the surrounding air space falls back to the selected lower limit temperature.

Figure 2:
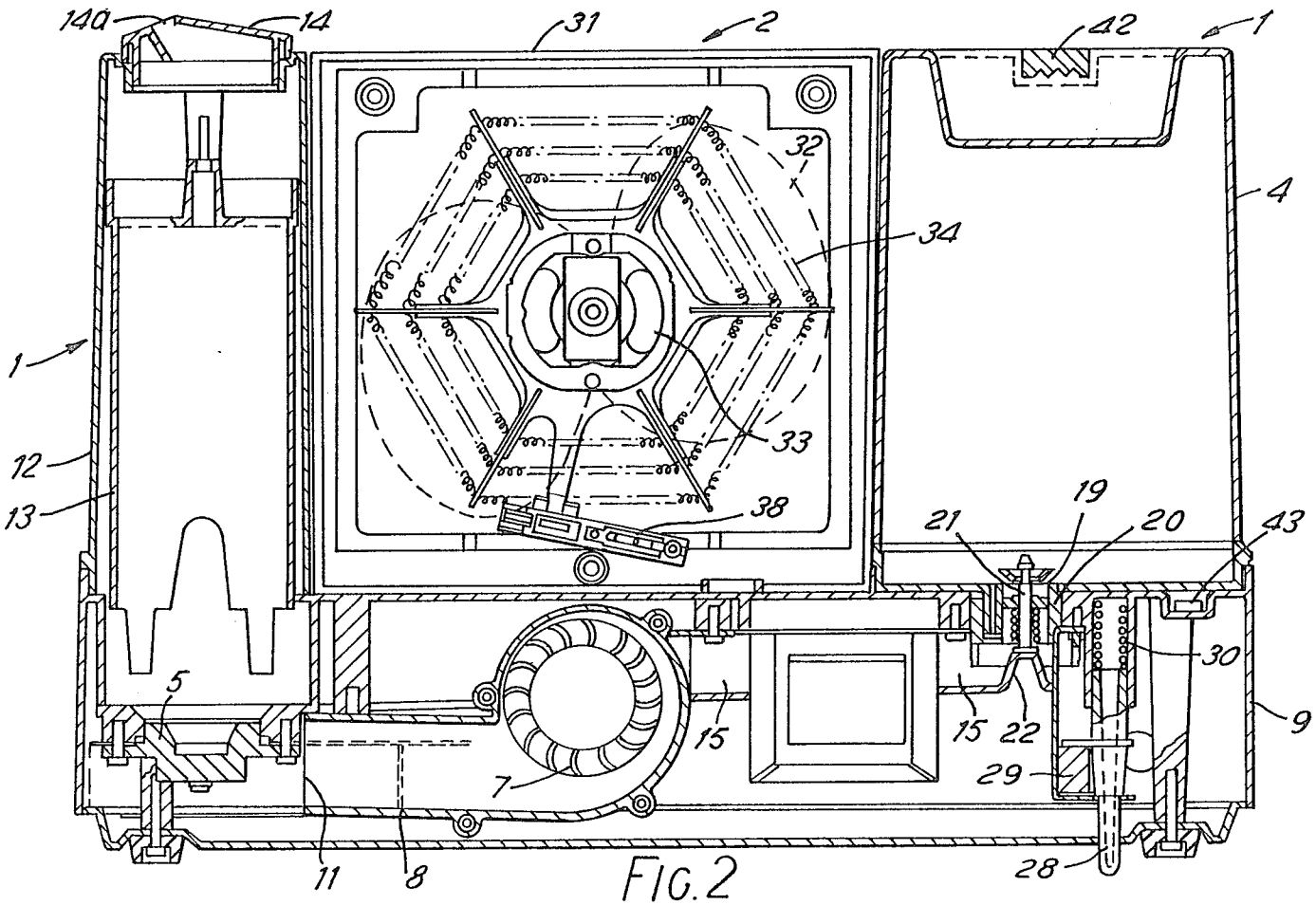
Figure 3:
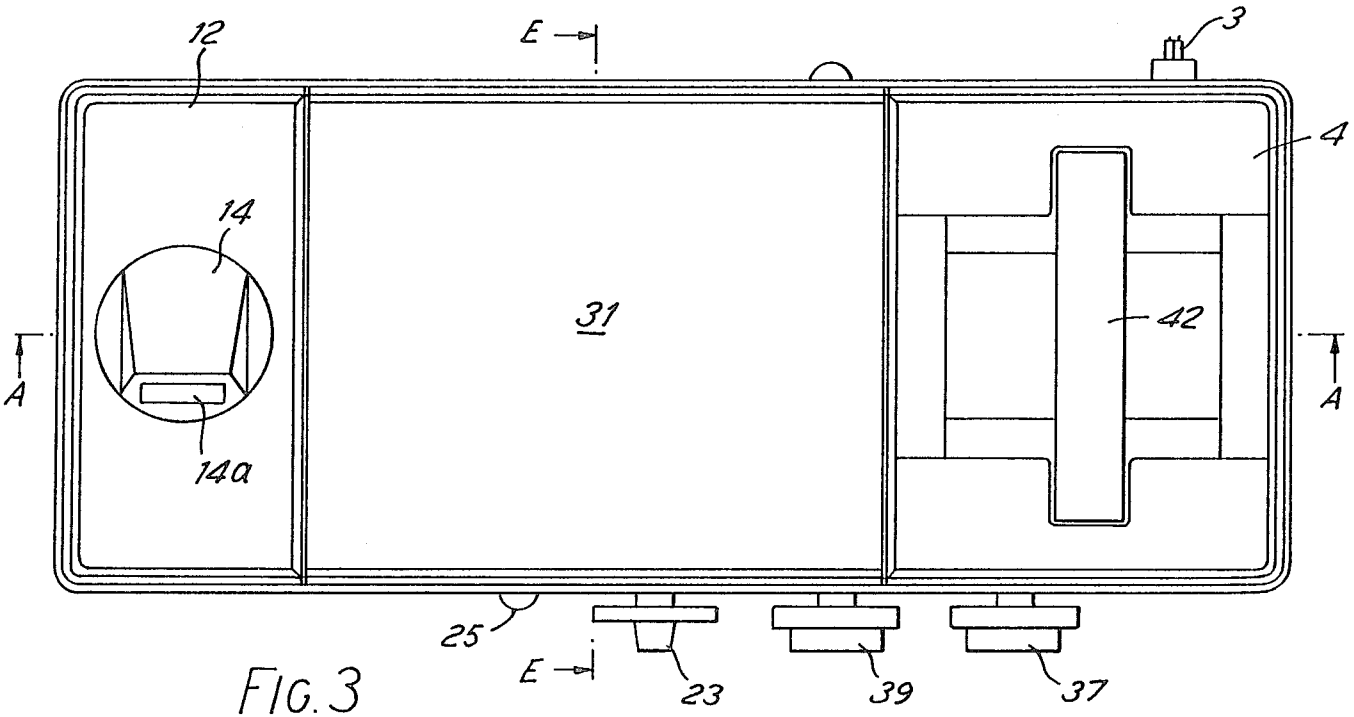
Figure 4:
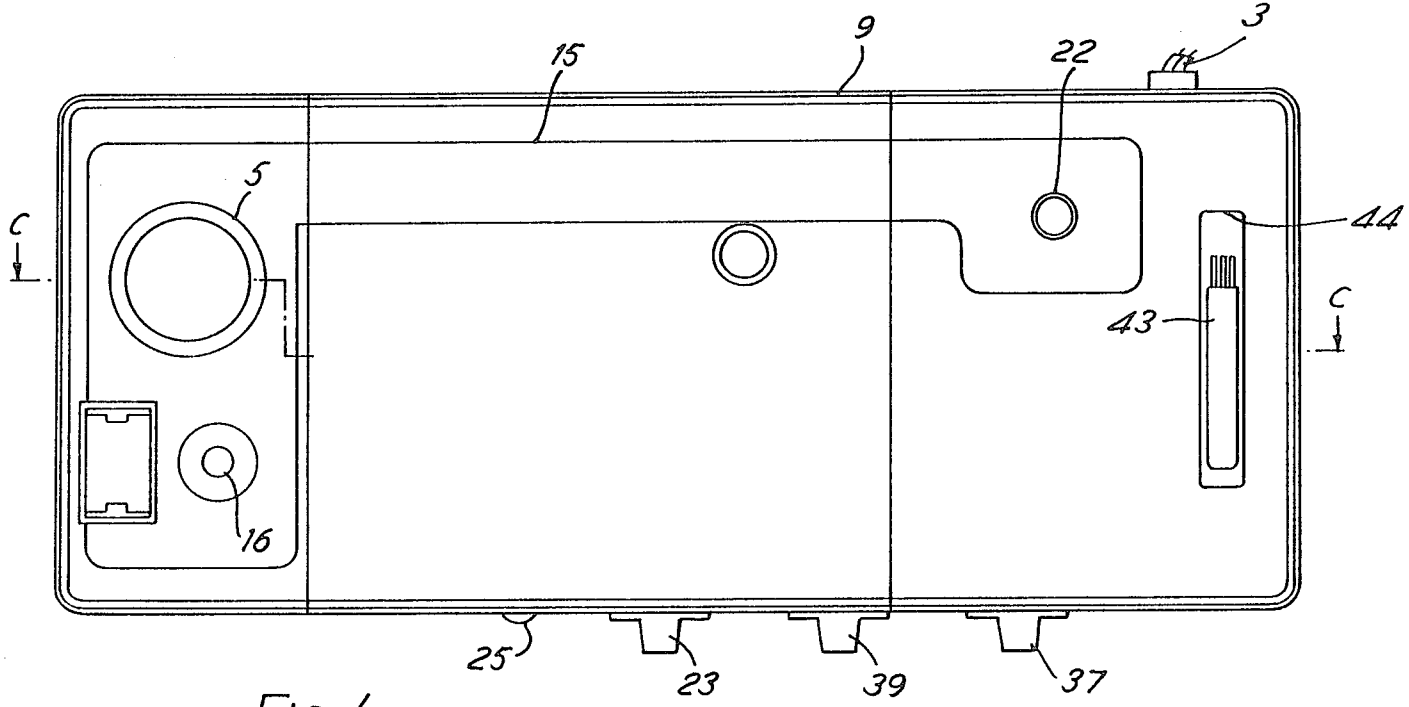
Figure 5:
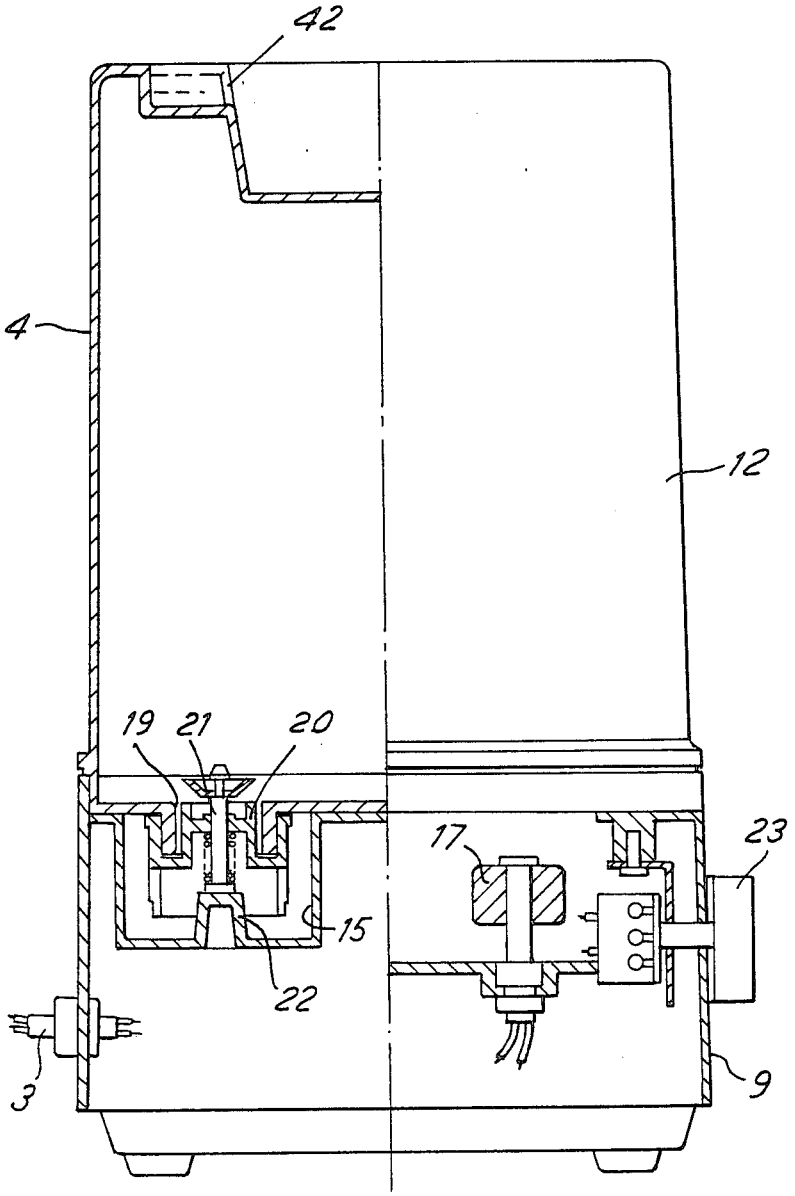
Figure 6:
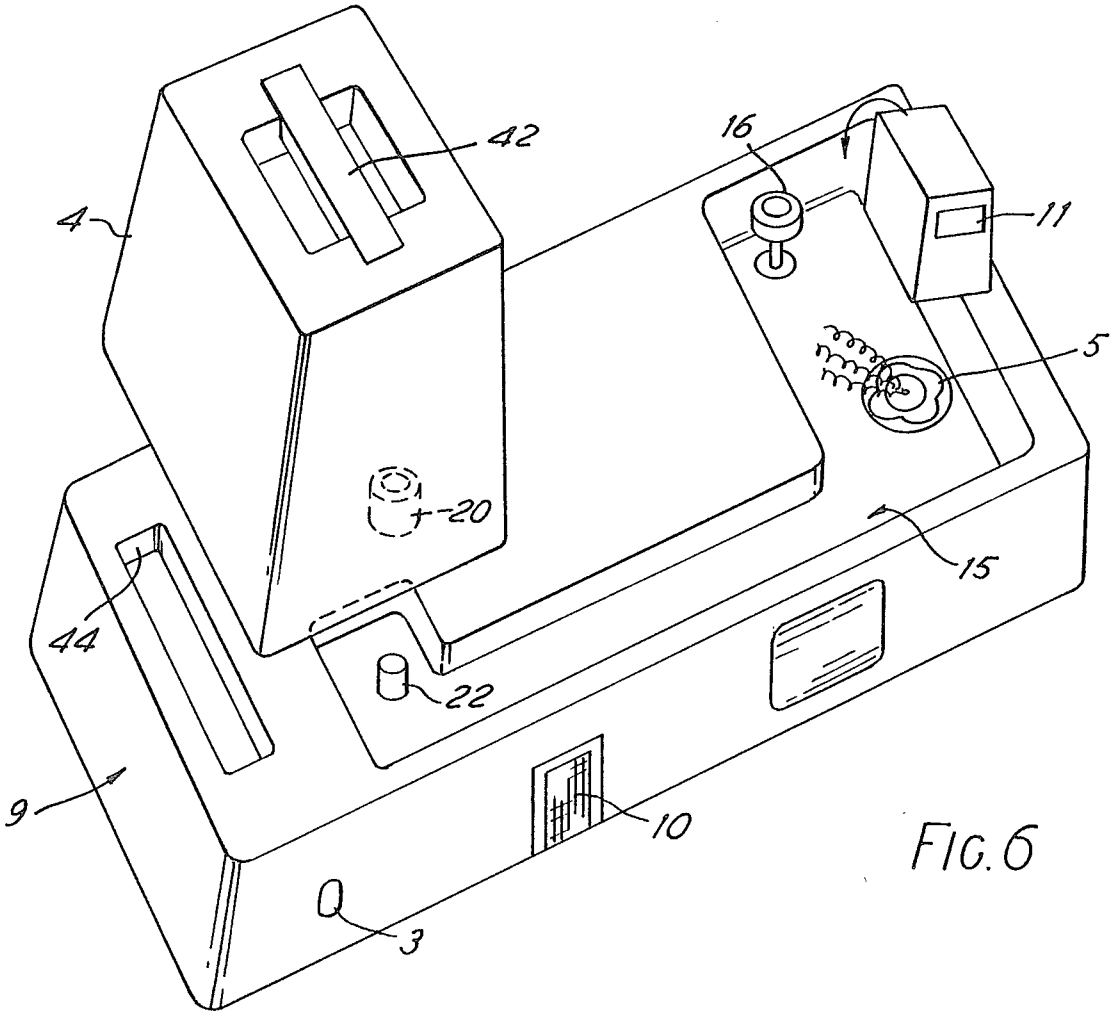
Figure 7:
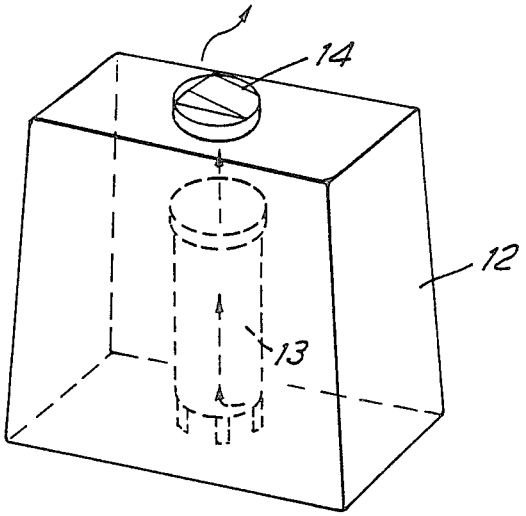
Figure 8:
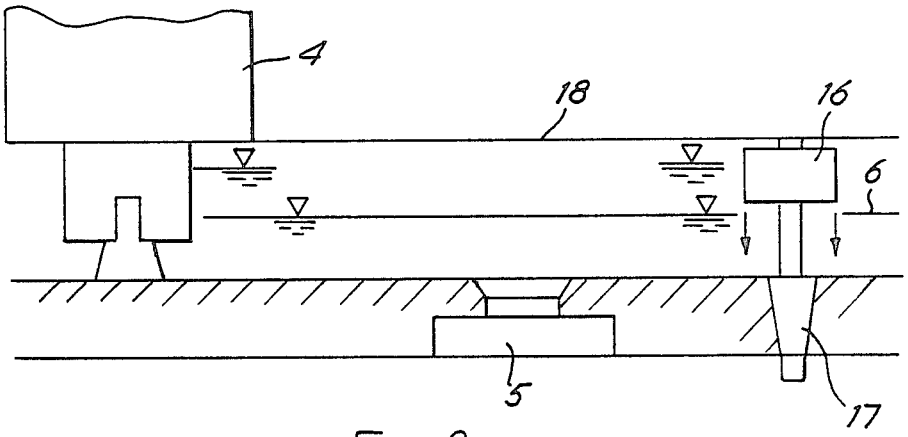
Figure 9:
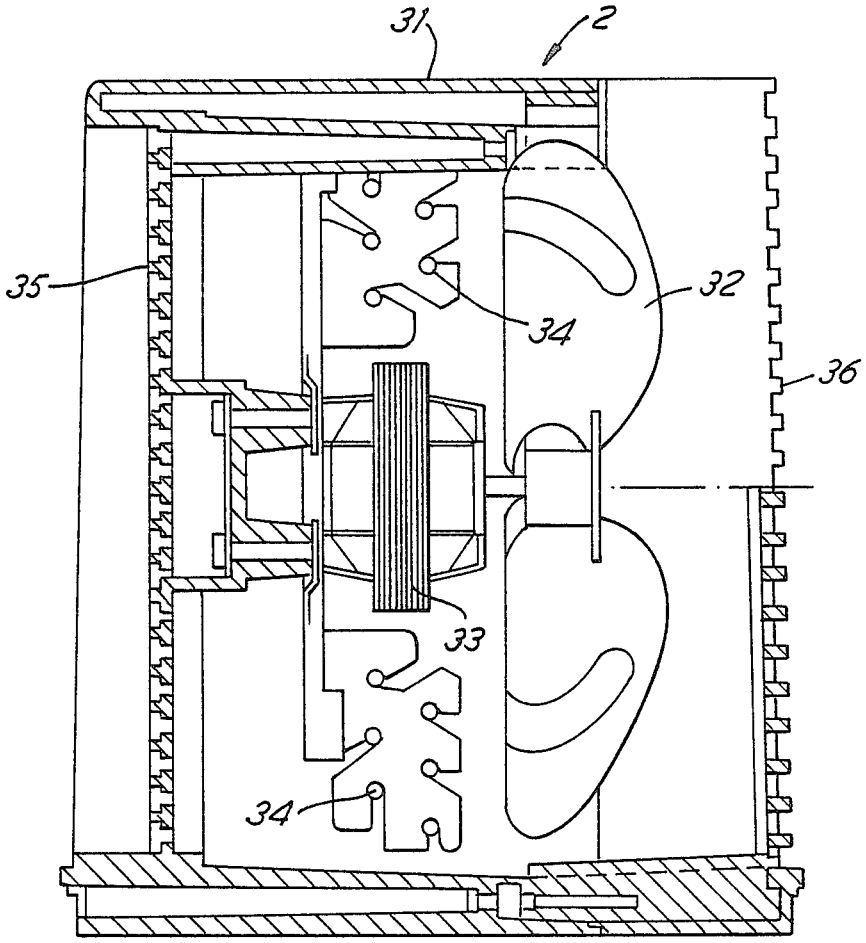
Figure 10:
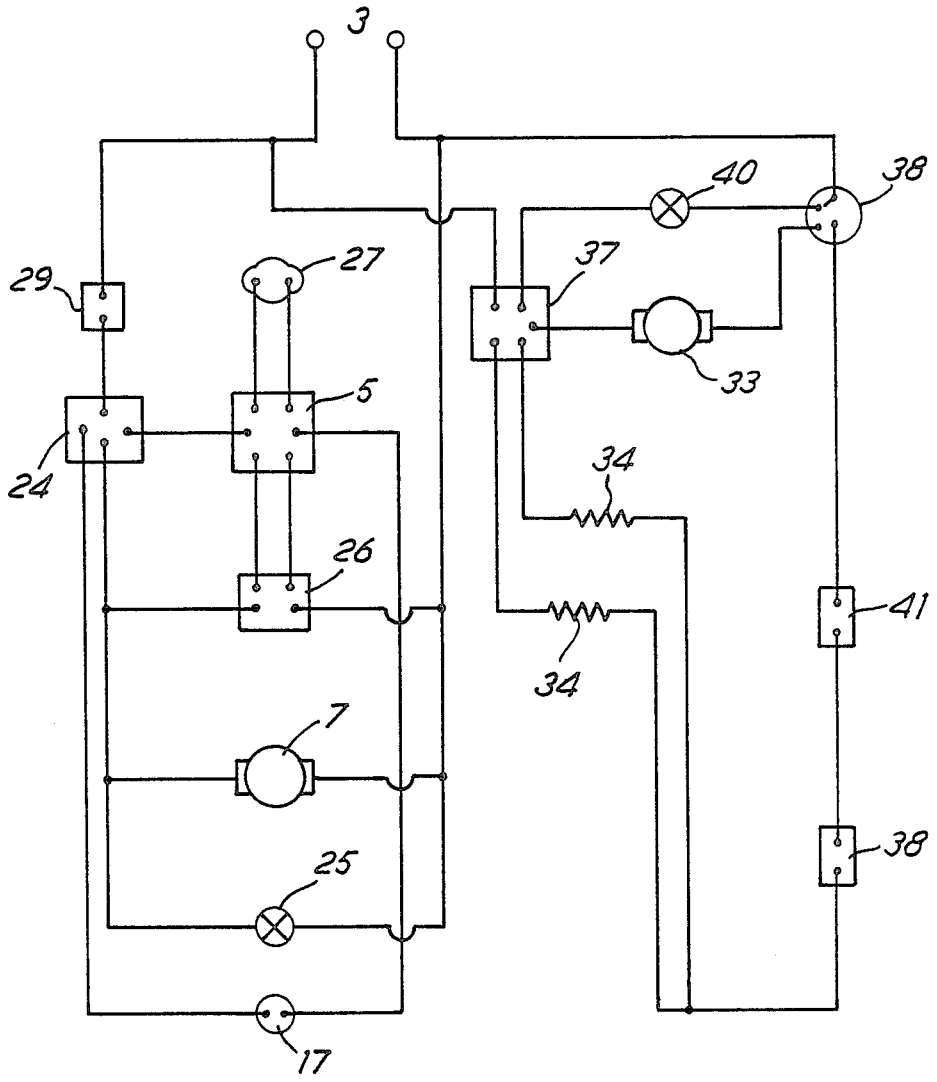

For a better understanding of the present invention and to show how the same may be carried into effect, reference will now be made, by way of example, to the accompanying drawings, in which:

FIG. 1 is a front view of a combined humidifier and fan heater unit according to a first embodiment of the invention, FIG. 2 is a vertical longitudinal cross-sectional view of the unit of FIG. 1 taken on the line A—A in FIG. 3, FIG. 3 is a view from above of the unit of FIG. 1, FIG. 4 is a horizontal longitudinal cross-sectional view taken on the line B—B of FIG. 1, with various parts of the unit removed for convenience, FIG. 5 is a part vertical cross-sectional view through the unit of FIG. 1 taken on the line E—E in FIG. 3 in the direction of arrows E, FIG. 6 is a diagrammatic perspective view from above of the unit of FIGS. 1 to 5 showing a base portion of the unit and separated associated water tank, FIG. 7 is a diagrammatic perspective view of a vapour chamber part of the unit of FIGS. 1 to 6, FIG. 8 is a diagrammatic sketch view illustrating operating on the supply of water to the vapour chamber, FIG. 9 is a transverse vertical cross-sectional view taken on the line E—E of FIG. 3 through a heater part only of the unit, and FIG. 10 is a diagrammatic circuit diagram of the unit of FIGS. 1 to 9.

A combined humidifier and fan heater unit of the invention as shown in the accompanying drawings basically includes a humidifier part generally indicated at 1 and a fan heater part generally indicated at 2. The unit is made from any convenient material such as plastics or metal and is supplied with electrical power via a power input lead 3. The humidifier part 1 is operable electrically to dispense water vapour into the surrounding air space for humidifying purposes and the fan heater part 2 is operable electrically either together with or instead of the humidifier part 1 to draw air from the surrounding air space through heating means, by which it is raised in temperature or not as desired, and blow it back into the surrounding air space.

The humidifier part 1 includes a refillable tank 4 for containing water and made of any convenient material such as plastics. The tank 4 is substantially rectangular in shape, slightly tapering towards the top, as can be seen from FIG. 6 which is a view from the rear of part of the unit of FIG. 1. The humidifier part 1 also includes a vibrator 5 conveniently in the form of an electrically operable ultrasonic transducer for receiving water from the water tank 4 and operable to impart a vibratory motion to the received water to raise some of it above the normal surface level 6 of the water when at rest. This normal water level surface 6 is shown in FIG. 8 where it corresponds to the lowermost level which the water is allowed to reach.

Also included in the humidifier part 1 is an air blower 7 in the form of an electric motor driven fan contained in a shaped housing 8 in a base portion 9 of the unit. The housing 8 communicates via an air inlet 10 at he rear of the base portion 9 with the surrounding air space so that air can be drawn through the inlet 10 by the air blower 7 through the housing 8 and through the vibrated water or across the vibrated surface of the water via an air outlet 11 to entrain water from the vibrated surface and break it up into droplets during passage up through a vapour chamber 12 and an atomizing tube 13 contained therein.

The vapour chamber 12 is provided with outlet means in the form of a rotatably mounted directional outlet knob 14 having an outlet aperture 14*a*, which outlet knob 14 is partially recessed in the upper surface of the vapour chamber 12. This vapour chamber 12 is generally rectangular in shape and tapers slightly towards the upper end thereof with the atomizing tube 13 extending from and communication with the base portion 9 as shown in FIG. 2. In operation by appropriate rotation of the outlet knob 14 and consequent direction of the outlet aperture 14*a* vapour formed by the air and entrained water droplets in the vapour chamber 12 can be discharged into the surrounding air space.

As shown in the accompanying drawings the water tank 4 and vapour chamber 12 are mountable in spaced apart location on the base portion 9 to leave a gap there between in which the fan heater part 2 of the unit is located.

To provide communication between the water in the tank 4 and the vapour chamber 12 a water channel 15, which is generally L-shaped in plan as shown in FIG. 4, is provided in the base portion 9. The vibrator 5 is mounted in the channel 15 in the portion thereof corresponding to the base of the L-shape. Also mounted in the channel 15 in the portion corresponding to the base of the L-shape, is a float 16 operable to move with the level of water in the channel 15 and operable to move with the level of water therein. The float 16 co-operates with a float switch 17 to cut out supply of electrical power to the vibrator 5, and hence stop it's operation, when the water level in the channel 15 forms from the upper level 18 to the minimum lower level 6 as shown in FIG. 8.

The water tank 4 is removable from the base portion 9 for filling purposes and has a filler orifice 19 in it's base through which water may be entered into the tank 4 with the orifice 19 uppermost. Valve means 20 in the form of a spring loaded valve member 21 and co-operating valve seat is provided in the form of a plug insertable in the filler orifice 19. The valve means is normally biased into a closed position in which the head of the valve member 21 is held shut against the valve seat in the valve means plug 20. When the water filled tank 4 with the valve means plug 20 in the filler orifice 19 is inverted to bring the valve means plug 20 into the lowermost position no water escapes as the valve means is normally closed. However when the inverted water tank 4 is put back in position on the base portion 9 of the unit a projecting valve rod 22 in the channel 15 engages and displaces the valve member 21 upwardly out of contact with it's valve seat to open the valve means 20 as shown in FIGS. 2 and 5. In this position water can flow from the tank 4 into the channel 15. Thus when control knob 23 is actuated it operates a control switch 24 and indicator light 25 lights up, electrical power is fed via a transformer 26 to the vibrator 5 which operates to pulse the water in the channel 15 upwardly. At the same time the air blower 7 operates, sucks air through the inlet 10 and blows it across and/or through the pulsating region of water above the vibrator 5 in the channel 15 to entrain water therein and carry it up through the vapour chamber 12 through the channel 15 and out through the outlet aperture 14*a* in the outlet knob 14. The vibrator 5 is provided with an oscillator 27. Additionally the humidifier part 1 includes a spring loaded projecting plunger 28 which co-operates with a contact switch 29 in electrical circuit with the supply of electrical power to the vibrator 5 and/or air blower 7. The plunger 28 and switch 29 are operable so that when the base portion 9 is normally located for operation on a flat, substantially horizontal surface, the plunger 28 is raised from the fully extended position as shown in FIG. 2 by engagement with the flat surface against the spring bias and holds the contact switch in a closed postion to permit flow of electrical supply current to the vibrator 5 and/or air blower 7. However when the base portion 9 is knocked over or lifted away from the flat surface of the plunger 28 extends back into the fully exended position as shown in FIG. 2 under the biasing force of the spring 30 to open the switch 29 and thereby cut off flow of electrical supply current to the vibrator 5 and/or air blower 7 and thus stop operation of the humidifier part 1 for safety. When water initially flows from the tank 4 into the channel 15 through the open valve means 20 air flows into the tank 4 therethrough to make up for the loss of water therein. However when the water level in the channel 15 rises to the upper level 18 the air supply to the tank 4 is cut off to prevent further water flowing into the channel until the level in the channel 15 drops once again sufficiently to allow air to flow once more into the tank 4 through the open valve means 20.

The fan heater part 2 includes a casing 31 containing a fan rotor 32, an electrically operable motor 33 for rotating the fan rotor 32 and an electrically operable heater element 34. The casing also is provided with an air inlet 35 in the form of a grill to the rear of the fan heater part 2 and an air outlet 36 also in the form of a grill on the front face of the fan heater part 2 as shown in FIG. 1. Thus when the on/off control switch 37 is switched on via the control knob thereof at the front of the unit 1 electrical power is supplied to the motor 33 and the fan rotor 32 rotates. A choice of cool or hot air is available by means of one or more thermostats 38 controllable via a control knob 39 to set desired upper and lower limit temperatures such that the fan heater part 2 will be switched off by the thermostats 38 when the temperature of the surrounding air space reaches the selected upper limit temperature and switched back on when the temperature of the surrounding air space falls back to the selected lower limit temperature. When the switch 37 is actuated an indicator lamp 40 lights up and a thermostat sensor 41 is activated. The degree of heat imparted to the surrounding air space by air drawn through the inlet 35 across the element 34 and blown back out through the outlet 36 by the fan blades 32 can be chosen by appropriate setting of the thermostat knob 39.

A carrying handle 42 for removal of the water tank 4 is provided in the upper surface thereof and a cleaning brush 43 is housed in a propriate recess 44 in the base portion 9 beneath the tank 4 for use in cleaning the valve means 20.

I claim:

1. A combined humidifier and fan heater unit including a humidifier part operable from a source of electrical power to dispense water vapour into the surrounding air space for humidifying purposes, the humidifier part being comprised of a refillable tank for water, a vibrator for receiving water from said water tank and operable to impart a vibratory motion to the received water to raise some of it above the normal surface of the water when at rest, an air blower operable to draw air from the surrounding air space through the vibrated water or across the vibrated surface thereof to entrain water therefrom and break it up into droplets during passage through a vapour chamber, and outlet means in said vapour chamber for discharging the vapour formed by the air and entrained water droplets, into the surrounding air space, and a fan heater part operable from a source of electrical power, either together with or instead of the humidifier part, to draw air from the surrounding air space, through heating means, by which it is raised in temperature or not as desired, and pass it back into the surrounding air space, the fan heater part being separately mounted from the humidifier part in such a manner that air can be separately drawn or forced through either part without being drawn or forced through the other part.

2. A unit according to claim 1 wherein the viibrator is an electrically operable ultra-sonic transducer.

3. A unit according to claim 2, including a base portion on which said water tank and vapour chamber are mountable in spaced apart location, with a water channel extending in the base portion between and in flow communication with the water tank and the vapour chamber, with the vibrator being mounted in said channel, and witha float being arranged in said channel to move with the level of water therein such as to operate a switch and cut-out supply of electrical power to the vibrator and hence stop it's operation when the water level in the channel falls below a predetermined minimum.

4. A unit according to claim 3, wherein the water tank is removable from the base portion for filling purposes and has a filler orifice through which water may be entered into said tank with the orifice uppermost, and valve means, normally biased into a closed position, insertable in said orifice, operable so that the water filled water tank with the valve means in the filler orifice may be inverted without loss of water through the closed valve means and placed back in position on the base portion which is provided with a projecting valve rod for opening the valve means when the water tank is in the correct location on the base portion, so as to allow water to flow there from into the channel.

5. A unit according to claim 4, wherein the base portion includes a spring loaded projecting plunger and co-operating contact switch in electrical circuit with the supply of electrical power to the vibrator and/or air blower, operable so that when the base portion is normally located for operation on a flat, substantially horizontal, surface the plunger engages the flat surface against the spring bias and holds the contact switch in a closed position to permit flow of electrical supply current to the vibrator and/or air blower, but when the base portion is knocked over or lifted from the flat surface the plunger extends under the spring bias action and opens the contact switch thereby cutting off flow of electrical supply current to the vibrator and/or air blower and stopping opeation of the humidifier part.

6. A unit according to claim 5, wherein the fan heater part includes a casing containing a fan rotor, an electrically operable motor for rotating said fan rotor, and an electrically operable heater element, an air inlet to said casing and an air outlet from said casing, such that air may be drawn into the casing from the surrounding air space through the air inlet by the rotating fan rotor, through the heater element to be heated as desired thereby and through the fan rotor and thereby blown out of the casing through the air outlet back into the surrounding air space.

7. A unit according to claim 6, wherein the fan heater part includes one or more thermostats selectively adjustable to desired limit temperatures such that when switched on the fan heater part will be switched off by the thermostats when the temperature of the surrounding air space reaches the selected upper limit temperature and switched back on when the temperature of the surrounding air space falls back to the selected lower limit temperature.

* * * * *